US005161464A

United States Patent [19]

Albrecht

[11] Patent Number: 5,161,464

[45] Date of Patent: Nov. 10, 1992

[54] BLOCK SLEEVE ASSEMBLY DEVICE

[75] Inventor: Hans Albrecht, Neuffen, Fed. Rep. of Germany

[73] Assignee: Bielomatik Leuze GmbH & Co., Fed. Rep. of Germany

[21] Appl. No.: 654,831

[22] Filed: Feb. 13, 1991

[30] Foreign Application Priority Data

Feb. 24, 1990 [DE] Fed. Rep. of Germany ..... 4005890

[51] Int. Cl.[5] ..... B41F 13/10

[52] U.S. Cl. ..... 101/375; 101/216; 101/219; 101/479

[58] Field of Search ..... 101/219, 216, 152, 153, 101/375, 479; 29/110, 116.1, 123, 234

[56] References Cited

U.S. PATENT DOCUMENTS 4,697,516 10/1987 Rombout ..... 101/216

4,807,527 2/1989 Knauer ..... 101/375

4,823,693 4/1989 Köbler ..... 101/375

*Primary Examiner*—Clifford D. Crowder

*Assistant Examiner*—Joseph R. Keating

*Attorney, Agent, or Firm*—Quarles & Brady

[57] ABSTRACT

In an assembly device for replacing the block sleeve on the roller core of a printing roller unit a support device with a gripper is provided, which so secures the unit immediately adjacent to one end of the roller core in the vicinity of two adjacent tilting moment support points, that from said single holding zone both ends of the unit project freely without any further support and are therefore readily accessible. On a printing press it is possible to provide for each printing mechanism an assembly device of this type, in which the particular printing roller unit can be directly inserted by an inserting device from the press or machine mount.

37 Claims, 3 Drawing Sheets

BLOCK SLEEVE ASSEMBLY DEVICE

FIELD OF THE INVENTION

The invention relates to an assembly device for the removal, fitting or replacement of block sleeves of printing rollers and the like.

BACKGROUND OF THE INVENTION

In the case of subject or size changes or wear, it is necessary to replace the block sleeve, which is fixed to the circumference of a support cylinder or roller core. For this purpose the machine or press body forming the printing roller must be so exposed, e.g. by removal of the bearing mounts located in the vicinity of its two ends, that it is freely accessible for the necessary assembly work. The printing roller is usually completely removed from the printing machine or press and inserted in a separate assembly device, with which the sleeve change can be carried out. This work is very cumbersome, because the printing roller must be supported in the vicinity of its two ends for sleeve change purposes and must therefore be extended at the assembly end by an auxiliary rod, which receives the elastically expandable block sleeve removed from the printing roller, e.g. with the aid of compressed air. Therefore, on changing the sleeve, the printing roller must be manipulated several times.

SUMMARY OF THE INVENTION

An object of the invention is to provide an assembly device of the aforementioned type, so as to avoid the disadvantages of known solutions and which in particular permits a very easy axial removal or fitting of the block sleeve on the roller core.

This object is achieved in that holding means are provided, which permit a freely projecting arrangement of at least the roller core over its entire length without the roller part, freely projecting up to one end, having any additional support or holding, so that it is freely accessible over its entire length and over the entire circumference. The closer the printing roller comes in this held state to a vertical position, the smaller the bending or tilting forces which occur in view of the total length of e.g. 1 to 2 meters of such a printing roller, whose block sleeve and roller core can exceed the length of one meter. For easy accessibility and handling, preference is given to an inclined to horizontal position of the printing roller on sleeve change. The holding means are then given a corresponding stable construction, and for stability purposes, are connected to an adequately large base surface, e.g. of a frame, which extends over a significant part of the printing roller length, but between which and the printing roller there are no further supports except in the vicinity of the holding means.

In place of an e.g. axially stressing or locking holding device axially connected to one end of the printing roller, preference is given to a holding device, which is contact free with respect to the block sleeve, but adjacent to one sleeve end engages in a circumferential area of the printing roller. Within the outer circumference the holding device can engage in the interior of the roller core and the freely projecting core length can be smaller than its total length.

Since at the time of sleeve change the printing roller can be relatively strongly, e.g. bending stressed, it is appropriate to construct the holding means as a bearing or support device and/or in the manner of a claw. There is no need for an axial stressing between roller surfaces at right angles to the roller axis and/or a radial stressing on at least one circumferential surface, but could be provided in those areas whose arc spacing about the roller axis is smaller than 180°. The printing roller can be very easily removed from or inserted in the holding device. Through the holding means the printing roller can be substantially free from movement or clearance and can be received in such a way that the roller core is adequately torsionally secured with respect to the support surfaces by the supporting force. Supporting appropriately takes place at or with two support points, which are successively positioned in the roller longitudinal direction in a spacing smaller than the support diameter or radius and namely on the same side above the roller axis and roughly equidistantly therefrom. One support surface is remote from the roller axis and the other, opposite surface faces the roller axis or is optionally further removed from the roller core or slightly nearer to the roller axis.

For the engagement of the holding device the printing roller appropriately has a diameter-reduced circumferential portion compared with the roller core and which is bounded on one flank or side by said core and on the other flank or side by a torus, e.g. a bearer connected to the core in torsionally resistant manner and on whose side remote from the core is connected a drive gear for the printing roller. If the holding device only engages in the gap between the flanks, then both opposite longitudinal portions of the printing roller are freely accessible from said flanks up to the ends. Components can be fitted independently of one another on both sides. The reduced circumferential portion appropriately forms an inclined guide surface opposite to the roller core face for aligning the engagement part of the holding device. This guide surface can be formed by the frustum-shaped transition surface between two longitudinal portions of different diameter of the circumferential portion and one can be associated with one of the two support points.

It is particularly advantageous if the holding device engages with the printing roller over only part of the circumference in the form of a support shell or tray, without it being necessary to provide a shell or tray opposite thereto, because then a particularly simple handling is ensured. The support shell, which appropriately extends over an arc angle of more than 90° and less than 180° and in particular over 150°, is located on the top of the printing roller and forms a centering alignment of the printing roller with a support surface thereof located on an outer circumference. A corresponding ring segment is closely adapted with its optionally cylindrical outer circumference surface to an inner circumferential surface of the printing roller or roller core, whilst the inner circumferential surface of said ring segment remains contact free from the roller body. If to the said ring segment is radially outwardly connected a locking surface for locking and movement, as well as for the engagement on the associated face of the roller core and/or the block sleeve, then the ring segment does not have to directly absorb axial stressing or clamping forces. This face forms an end stop on engaging the block sleeve, which is then precisely accurately aligned with respect to the roller core.

For the purpose of axial, positive locking, it is conceivable to distribute one or more locking members between the arc ends of the optionally subdivided or interrupted ring segment, but it is advantageous if there are only two axial locking members. One of these is provided on the ring segment arc end belonging to the working side for the operator and is immediately adjacent to said arc end. This locking member can e.g. be a displacement eccentric, which is rotatable about an axis at right angles to the roller axis or approximately tangential to the ring segment and is provided on the outer circumference with at least one locking surface, such as a pressure and stop surface. An approximately radially movable locking member appropriately faces said axial locking and movement member in the vicinity of the other ring segment arc end in one of the said angular spacings. Whilst the first locking member reciprocally and in particular axially aligns the printing roller and the holding device, the second locking member can also have an axial alignment function, but it appropriately senses, e.g. on the guide surface whether the holding device and the roller are securely in the reciprocal engagement end position. For example, said locking member can have a tapered front end as an inclined surface and can be engaged thereby on the guide surface facing the associated roller core face.

To permit particularly easy insertion of the printing roller the holding device forms an insertion jaw for said roller and whose width is at least as large as the external diameter of the associated support portion of the printing roller and which appropriately extends over an arc angle of more than 180° or 200°. A jaw leg or side and in particular the rear one is appropriately approximately linearly extended in the insertion direction as an extension of the ring segment or arc shape, the radial locking member being provided in said jaw side or subsequently on the associated arc end. If when considered radially to the roller axis on its inside, the said jaw side is tapered in acute-angled manner to its free end, it can easily form an alignment member, which during the insertion of the printing roller comes into engagement first with its gap or circular groove and by sliding on the gap sides brings about the axial alignment of the roller, which is appropriately inserted roughly in the longitudinal direction of the said jaw side.

A particularly advantageous further development of the invention comprises a device for inserting or removing the printing roller being associated with the holding device and as a result said roller can be transferred from a remote and in particular substantially radial starting position until it engages in the holding device. For the holding of the printing roller the inserting device appropriately has exclusively bearing surfaces, on which the printing roller can bear in freely raisable manner, so that there is no need for a separate fixing or detachment of the roller with respect to the inserting device and the latter is detached again by retraction from the printing roller inserted in the holding device.

Advantageously the inserting jaw of the holding device is substantially open to the bottom and/or front, whilst the inserting device is constructed as a lifting device. To ensure that the inserting device does not move back before the printing roller is completely secured or released in the holding device, the retraction or moving back movement of the inserting device can be controlled as a function of the locking position of one or all the locking members and for this purpose corresponding control contacts are operated. The raising and stopping of the inserting device can also be controlled as a function of the position of at least one locking member. The locking member can be motor-driven by means of a servo-drive and/or it can be operated directly by hand or with a wrench.

To ensure that no excessive stresses or loading occur on inserting the printing roller into the holding device, the latter is appropriately resiliently mounted between two end positions in the inserting direction against spring and/or weight force. If the printing roller is inserted with a support member of the inserting device in the holding device, said support member could be cushioned or resiliently mounted with respect to the inserting device.

In order that the interengaging members of the support device and printing roller engage on one another with relatively closely toleranced support or mating surfaces and can still be relatively easily engaged with one another, the holding device part engaging in the printing roller and the latter are very easily movably mounted with respect to one another towards the roller axis. Instead of an also possible movable mounting of the holding device with respect to a machine frame the printing roller is appropriately axially mounted on linear raceways, such as needle bearings, which e.g. form bearing surfaces for the support members of the inserting device. It would also be possible for the support members or the inserting device to be completely movably mounted in the said direction. The bearing surfaces are advantageously cross-sectionally prismatic and for each end of the printing roller is provided a bearing support, whereas no such support is provided in the vicinity of the roller core, roller body, bearer and/or drive gear. The bearing support is appropriately closer to the associated end of the printing roller than the holding device or between a roller bearing and the said end. With the bearing support can be associated a shaft-like stub connected by means of said bearing or an outer race thereof to the roller body and does not rotate with the latter.

The inserting device can also be replaced by a roller crane, whose lifting movements are freed or blocked via the position of the two locking elements.

An object of the invention is to provide an assembly device of the aforementioned or a similar type in that it is directly positioned on a printing press and/or in such a way that the inserting device can transfer the printing roller from the press mounting directly into holding means for the printing roller or back into the press mounting. Therefore for sleeve replacement purposes the printing roller does not have to be completely removed from the press and instead, after opening the bearing blocks and freeing the movement path thereof, it is directly transferred from the machine or press mounting in a substantially axially parallel alignment into the holding means in an approximately linear manner. For freeing the movement path the inking mechanism e.g. combined into an inking mechanism slide and having a screen roller and a dipping roller is moved approximately at right angles and roughly horizontally away from the printing roller e.g. towards the front of the press. If the back-pressure roller associated with the printing roller is located on the side of the latter remote from the inking mechanism, then when the printing roller is removed from the press mounting it can be easily freed from the back-pressure roller in that the lifting direction is slightly inclined away from the back-pressure roller.

The inventive construction is particularly suitable for printing presses or machines, whose printing mechanism are directly superimposed and/or laterally adjacent on remote sides of the press. With each printing mechanism can be associated an independent or separate assembly device. Between superimposed printing mechanisms or holding means it is possible to provide an inserting device directly below the roller axis, so that below each printing roller is provided an inserting device and above the particular roller a holding device. The printing roller is appropriately mounted on freely projecting, lateral arms of the machine or press frame, on or between which can also be fixed the inserting device.

BRIEF DESCRIPTION OF THE DRAWINGS

These and further features of preferred developments of the invention can be gathered from the claims, description and drawings and the individual features can be realized singly or in the form of subcombinations in an embodiment of the invention and in other fields, whilst representing independently protectable constructions for which protection is hereby claimed. Embodiments of the invention are described in greater detail hereinafter relative to the drawings, wherein show:

DETAILED DESCRIPTION OF THE PREFERRED EMBODIMENTS

Figure 1:
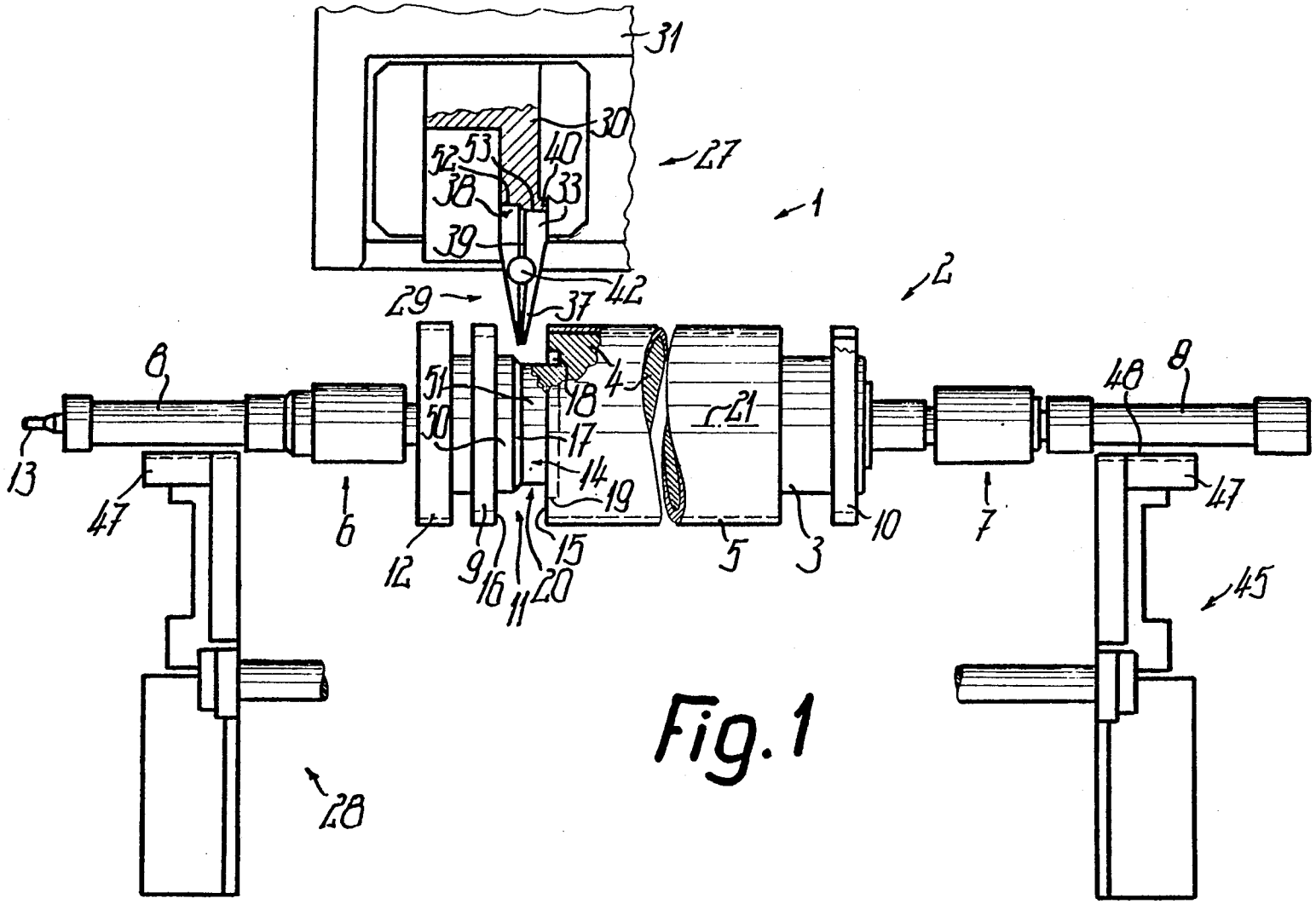
FIG. 1 An inventive assembly device in a part sectional view and in a simplified representation.

The assembly device 1 according to FIGS. 1 to 4 serves to receive a printing roller unit 2 exclusively on a single longitudinal portion shorter than its external diameter or radius and then both residual longitudinal portions are so carried in freely projecting manner without any further support that both are simultaneously accessible for any assembly or fitting work. The printing roller unit 2 has a rotary roller body 3 with a through, cylindrical roller core 4, on whose outer circumference is interchangeably arranged an equally long block sleeve 5 in one piece over its circumference. The roller body 3 is mounted with reduced end portions in two bearings 6, 7, whose individual roller or antifriction bearings are arranged with their outer rings or races so as to be fixed in a bearing sleeve and with which the printing roller unit 2 can be placed in bearing mounts of a printing press. To the bearing sleeves are fixed shaft journal-like end portions 8 of the printing roller unit 2, which are provided between projecting collars with in each case one cylindrical central portion used for supporting or mounting the printing roller unit 2. Each end portion 8 can be removed by unscrewing.

With a limited axial spacing adjacent to each end of the roller core 4 is secured against rotation on the roller body 3 a narrow, projecting collar 9, 10, whilst being fixed so as to be axially removable and which is constructed as a bearer and has on the outer circumference of a circular disk a slightly elastic coating or covering, whose external diameter is roughly the same as that of the sleeve 5. At one end of the roller core 4 is secured against rotation with a limited axial spacing adjacent to the outside of the associated torus 9 a drive gear 12, but can be axially removed together with the torus 9 and is fixed to a cover on the roller body 3, which with the torus 9 forms a flanged constructional unit and is located immediately adjacent to the associated bearing 6. This unit is arranged on a triple stepped shaft or roller portion decreasing in diameter towards the associated end and which forms three seats. The pitch circle diameter of the gear 12 is roughly the same as the external diameter of the sleeve 5 and with respect to which the external diameter of the drive gear 12 is larger by the tooth height. On the end portion 8 associated with the said drive side of the pressure roller unit 2 is provided a compressed air connection 13 in the form of a nipple or the like projecting past the end face and which is connected by means of a central channel traversing the end portion 8, the sleeve of the bearing 6 and the roller body 3 extending in one piece into the latter with openings in the outer circumference of the roller core 4, so as to press away the sleeve 5 during assembly.

The support portion 14 of the roller body 3 forms a connection between the roller core 4 and the torus 9 for engagement of the assembly device 1, the support portion 14 has a reduced external diameter compared with the core 4 and the torus 9 and defines on a bottom 20 a circular groove-like engagement gap 11, which is laterally bounded by annular sides 15, 16 at right angles to the roller axis 21. The annular sides 15, 16 can be provided by the faces of the roller core 4 and the sleeve 5 on the one hand and the associated face of the torus 9 on the other. The diameter of the support portion 14 is slightly reduced between the sides 15, 16 towards the roller core 4, and the frustum-shaped transition surface between two circumferential portions 50, 51 forms a guide surface 17. In the side 15, a circular groove-like reception opening 18 is provided. The internal diameter of the opening 18 is the same as the connecting part of the support portion 14, so that the latter extends into the interior of the roller core 4. The diameter-corresponding, further outer surface 19 of the reception opening 18 is also cylindrical. All said elements are bounded axially symmetrically to the roller axis 21 or by surfaces of revolution, so that they cannot lead to unbalances.

Figure 2:
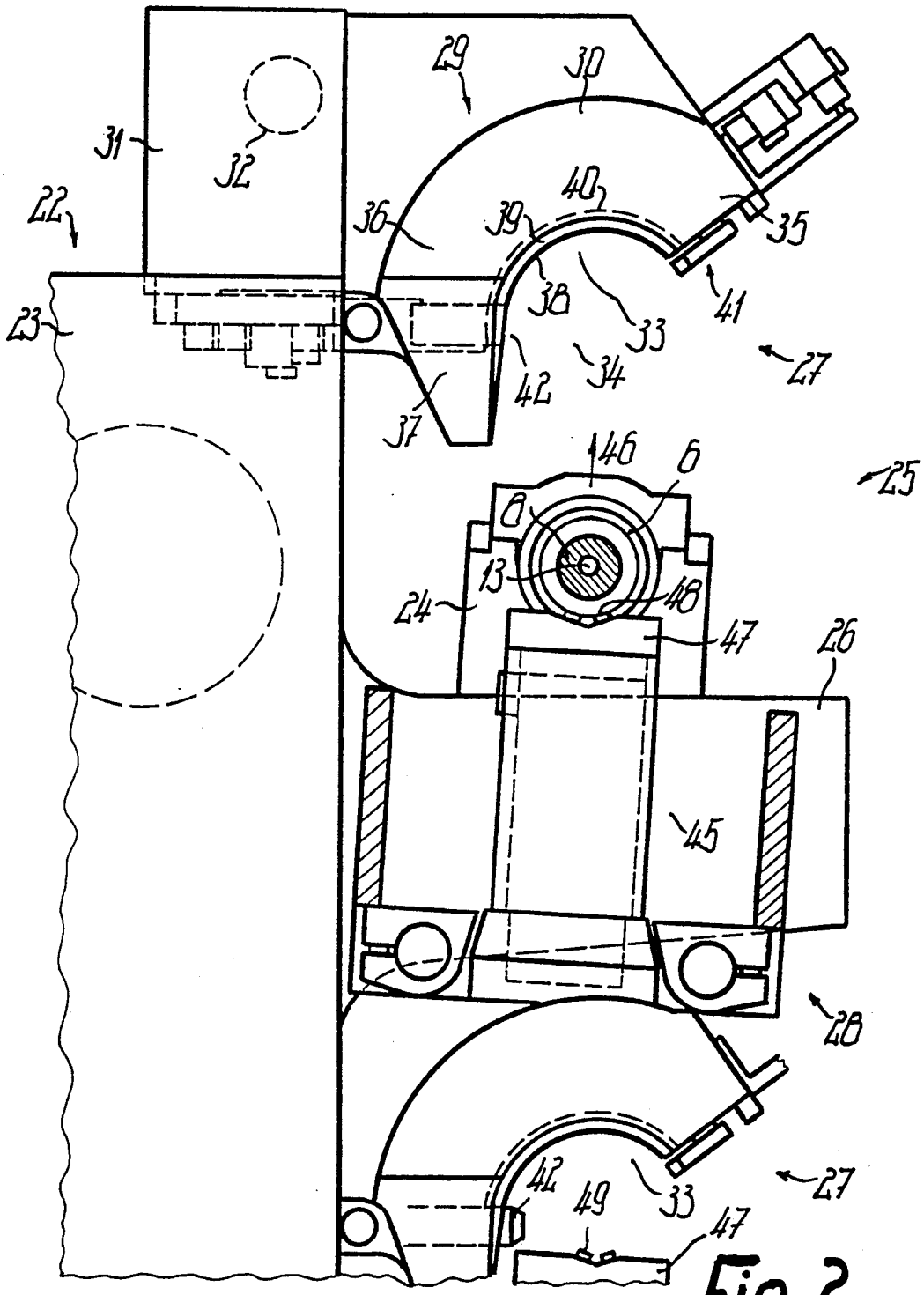
FIG. 2 A detail of an assembly device in an axial view.

The assembly device 1 is appropriately located directly on the frame 23 of a printing press 22, which in the manner of a tower has at least two superimposed, separate printing mechanisms, with in each case, a printing roller unit 2, an opposite roller indicated in broken line form in FIG. 2 and located in the frame 23 and a not shown inking mechanism. For each bearing 6 or 7 of each horizontal printing roller unit 2 are provided two upright bearing blocks 24, in which are fixed the bearing sleeves and whose upper parts are easily detachable for removing the printing roller unit 2. The two equiaxial bearing blocks 24 with a common slide can be displaceably mounted in stop-limited manner against the opposite roller roughly horizontally on freely projecting support arms 26 of the frame 23, so as to set the roller spacing to different roller diameters or to bring the printing roller unit 2 into the starting position with respect to the assembly device 1 shown in FIG. 2. The inking mechanism is appropriately located on the side of the printing roller unit 2 remote from the opposite roller and is also displaceably mounted in the form of a slide on the support arms 26 in the said direction, so that it can be adjusted and moved away from the unit 2. The printing roller units 2 are located freely on an outside or front side 25 of the frame 23.

The assembly device 1 has a holding device 27 enabling the printing roller unit 2 to be horizontally fixed in an axially parallel, but displaced, i.e. raised position with respect to its working position, exclusively on the support portion 14. The holding device 27 is directly above the printing roller unit 2 in the working position. Immediately below the said unit 2 is provided an inserting device 28 on the support arms 26 enabling the unit 2 to be raised directly out of the bearing blocks 24 and supplied at right angles to the roller axis 21 and in linear manner to the holding device 27 until locking takes place.

Each holding device 27 has a support head or gripper 29 projecting freely in hook-like manner on the front 25 of frame 23 and having an approximately ring segmental gripper body 30, which is so pivotable with a bracket 31 on a bearing 32 with respect to the frame 23, that on inserting the printing roller unit 2 it can yield into its gripping receptacle 33 if excessive forces occur. The axis of the bearing 32 is higher than the central axis of the gripping receptacle 33 and is so displaced with respect to the latter towards the frame 23, that the movement path of the gripping receptacle is directed away from the frame 23 and therefore the opposite roller, besides in the upwards direction. In the starting position the gripper body 30 which is slightly narrower at least in the vicinity of the gripping receptacle compared with the gap 11 is stop-limited. The gripper body 30 can be adjustable or fixable parallel to the roller axis with respect to the bracket 31 or the frame 23, or can be freely movable between two stop positions, so as to bring about automatic alignment with respect to the gap 11.

The gripping receptacle 33 which is substantially pitch circular bounded in axial view towards the front 25 only extends to an area above the associated roller axis and on the opposite side to below the same, so that an insertion jaw 34 is formed, which is open to the bottom and partly to the front 25. Thus, between the bearing block 24 and the gripper 29 a gap open to the front 25 is formed, so as to permit removal from the printing press of the printing roller unit 2 completely exposed on the outside of the frame 23 at least in the sleeve assembly position and accessible over its entire circumference and length. The front, forwardly inclined and downwardly directed jaw side 35 ends approximately in an upwardly sloping axial plane of the gripper axis, whilst the rear jaw side 36 immediately adjacent to the front of the frame 23 passes into a downwardly projecting aligning member 37, whose two flanks converge in acute-angled manner towards its lower free end according to FIG. 1 and consequently form inclined guide surfaces for sliding on the flanks 15, 16 and for the reciprocal alignment of the gripper 29 and the support portion 14.

The inner circumference 38 of the gripping receptacle 33 curved around the gripper axis is offset approximately complementary to the outer circumference of the support portion 14 or the bottom 20, so that between two differently wide circumferential portions 52, 53 is formed a countersurface 39 complementary to the guide surface 17 and which extends into the free end of the aligning member 37, but continuously decreases in flank height towards the said free end. During the radial insertion of the printing roller, the countersurface can slide in axially aligned manner on the guide surface 17. The further circumferential portion 52 appropriately has the same radius of curvature to the associated circumferential portion 50 on the outer circumference of the support portion 14, so that said circumferential surfaces engage in large-area manner on one another as support surfaces in bearing engagement. The narrower inner circumferential portion 53 is wider than the associated circumferential portion 51.

On its face 54 associated with the roller core 4 the gripper body 30 has a positionally rigid support member 40 curved in ring segmental manner about the gripper axis and extending coaxially over the entire, curved inner circumference 38, which projects in ridge-like manner over said face 54 by an amount smaller than the depth of the opening 18, forms an extension of the narrower portion 53 of the inner circumference 38 or support area and has as the support face 55 an outer circumference closely diameter-adapted to the outer flank 19 of reception opening 18. The support area 40 extends over an arc angle of approximately 150° and extends into the aligning member 37. The support or circumferential surface 52 extends to the associated face of the gripper body 30.

On the end face of the jaw side 35 is rotatably mounted an axially acting displacement and locking member 41 about an axis at right angles to said end face and in the form of a thin eccentric disk, whose median plane is located roughly in said inclined axial plane of the gripper axis. The locking member 41 forms with its outer circumferential surface a curve, which has multiply different axial spacings from its rotation axis and forms a continuously rising cam 43, which is steeply limited at one flank. On radially inserting the support portion 14 into the gripper 29 said cam 43 is aligned in the direction of the roller axis 21, so that it forms with the diametrically facing curved portion having the smallest spacing from the eccentric rotation axis guide surfaces, which can slide on the flanks 15, 16 and the cam 43 projects as far as the support member 40 and consequently has a blocking action against its engagement in the reception opening 18.

Figure 3:
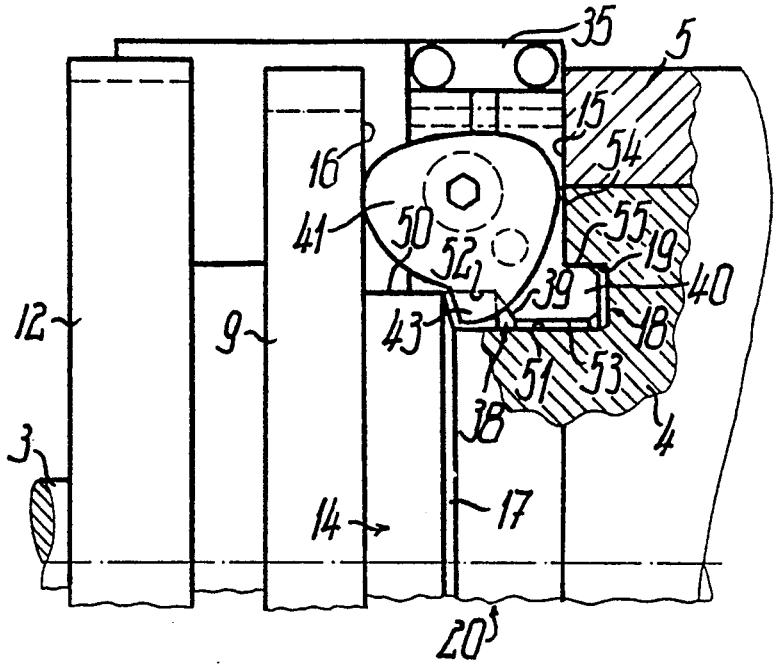
FIG. 3 A detail of FIG. 2 in a view of a locking member and on a larger scale.
Figure 4:
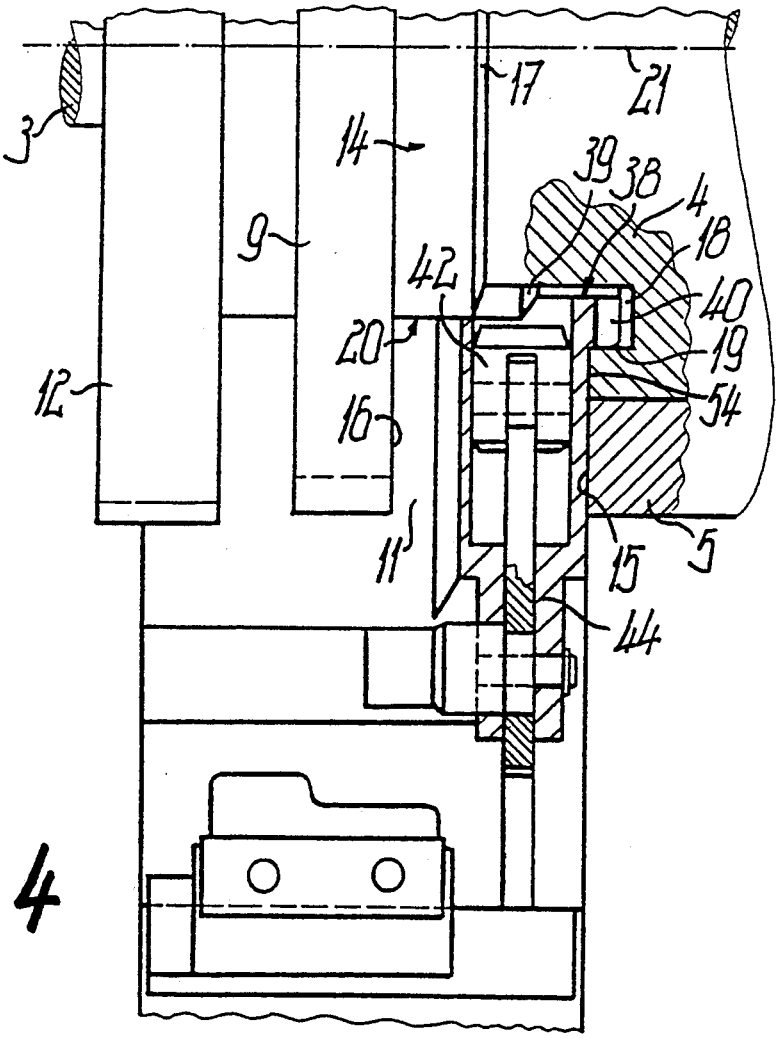
FIG. 4 A longitudinal section through a further locking member according to FIG. 2.

The displacement and locking member 41 is then turned by approximately 90° in the position shown in FIG. 3 until the steep cam flank or side is directly adjacent to the guide surface 17, a curve being supported on the flank 16 and the complete printing roller unit 2 moves in such a way until the support member 40 is completely inserted in the reception opening 19 and the associated face 54 of the gripper body 30 engages in substantially whole-surface manner on the associated arc portion of the flank 15. The printing roller unit 2 could also be moved from the outside, e.g. manually. The outer circumferential surface 55 of the support member 40 engaging on the outer flank 19 centers the printing roller unit 2 precisely with respect to the holding device 27 and forms one of the two support points. In the holding position, the support member 40 is located entirely within the roller core 4, which is supported on the ring face 38 with its associated roller face so as to counter tilting movements. As the support member 40 and the surface 38 assume an arc angle of less than 180°, they can be introduced relatively easily or virtually without contact into the reception opening 18 in any rotation position of the roller body 3.

In the transition area between the inner circumference 38 and the aligning member 37 or in the associated end region of the support member 40 is provided a radial locking member 42, whose central axis is located in the associated axial plane of the gripper axis and is reciprocatable parallel to said axial plane in a bore or the like of the gripper body 30 via a gear 44, such as an eccentric and guide drive. The central axis of the bolt-like locking member 42 is located roughly in the plane of the end, associated with the countersurface 39, of the further support portion 52 of the inner circumference 38 and is insertable exclusively against the outer circumference of the diameter-reduced part 51 of the support portion 15 directly adjacent to the guide surface 17. If the support member 40 has not completely entered the reception opening 18, then the front, acute-angled, frustum-shaped, tapered end of the locking member 42 does not pass entirely into the axially acting locking position. With the locking member 42 the pressure roller is possibly displaced to such an extent that the support member 40 is completely inserted in the circular groove 18 and the face 15 of the pressure roller engages on the face 54 of the gripper body 30. If this condition is fulfilled, the locking member 42 can be moved or slid in and the displacement and locking member 41 is tightened, so that it cannot be turned without a wrench. In this state the guide surface 17 is spaced from the countersurface 39. The described construction ensures that with a simple and relatively lightweight construction and easy insertion, there is a very reliable holding of the printing roller unit 2 in the holding device 27.

The printing roller unit 2 is inserted from below into the gripping receptacle 33 with a lifting device 45 of the inserting device 28, the lifting direction according to arrow 46 being slightly forwardly inclined, because the gripper axis is slightly upstream of the roller axis 21 of the printing roller unit 2 in the starting position. The lifting device 45 remains in the raised position until the locking members 41, 42 have engaged, a signal then being supplied to the lifting drive, so as to permit lowering to the starting position. A lowering sensor must be operated for safety reasons. After the start of the lowering movement the printing roller is supported on the ring segment surface 38 and the outer face 55 of the nose 40 of the gripper body 30. Based on the gripper body 30, the torque of the roller weight is the same as the supporting moment of the bearing forces on the gripper body. For engagement in the central portion of each end portion 8 the lifting device 45 has a support member 47 with, in axial view, an obtuse-angled, V-shaped or prismatic support surface formed on each prism side by a series of successive roller bodies 49. Thus, with respect to the inserting device 28, the printing roller unit can be very easily axially reciprocated.

The lifting device 45, whose two support members 47 are mechanically interconnected synchronously in drive manner, can e.g. according to FIG. 1 have for each support member 47 a rack gear or according to FIG. 2 a lifting shear arm, which is formed by shear members crossing in joints and joined by means of joints at their ends. In FIG. 2 there are two articulation points for the bottom shear members in the lower region of the support arm 26.

Following the retraction of the inserting device 28 the printing roller unit 2 is easily accessible from its end remote from the holding device 27 for replacing the sleeve 50 and for this purpose the associated torus 10 is removed or can remain in its fitted position. From the beginning to end of sleeve assembly the printing roller unit 2 can be secured exclusively by the holding device 27 without any additional support, so that no further manipulations of unit 2 are required. It is possible to work simultaneously on both roller sides, which permits considerable time savings in the case of size changes. On changing the printing circumference (thicker sleeve) the gear 12 and the bearer 9, because they are also freely accessible, can e.g. be replaced by a further gear and bearer matching the new sleeve diameter.

After equipping the printing roller unit 2, it is taken from the inserting device 28, returned to the bearing blocks 24, secured by the closing thereof and is then set, including the inking mechanism, with respect to the opposite roller, so that after a very short time operation of the associated printing mechanism can be resumed. On releasing the gripper the cam 43 again runs onto the flank 15 and therefore presses the support member 40 out of the reception opening 18. As the two locking members 41, 42 are constructed in the manner of a sequence control through which the printing roller is secured in the support member 40 in the engaged state with the locking member 42, it is firstly necessary to retract the latter. The lowering process is appropriately only possible when the printing roller has been completely removed from the gripper body 30, i.e. the locking members 41 and 42 are brought into the inserted position. The lifting device can be replaced by a roller crane, if the said lifting movements, optionally in a suitable safety circuit, are to be electrically locked to the positions of the locking members 41 and 42.

The holding device 27 appropriately holds the printing roller unit 2 only by tilting moment bracing under its own weight, without any other bracing being required. Following a radial adjustment movement, the support points are brought into engagement only by a longitudinal movement and are secured in substantially tension-free manner against retraction. The support points are located within a single gap 11. The holding device is advantageously fixed in easily interchangeable manner in order to be able to hold different roller sizes.

I claim:

1. A block sleeve assembly device for mounting and dismounting a block sleeve (5) of a roller core (4) of a roller body (3) of a printing roller unit (2), said device comprising:

a support means for supporting a printing roller unit (2) in a printing position holding means for supporting a roller body (3) in a sleeve mounting and dismounting position, and wherein said holding means has a holding device (27) for gripping a roller body (3) at a first position, said holding means supporting a roller body at said first position in a cantilevered manner for mounting and dismounting of the block sleeve (5) and said holding means supporting a roller body independently of said support means during said mounting and dismounting of the block sleeve.

2. The assembly device according to claim 1, wherein said holding device (27) has two successive support points spaced in a longitudinal direction of said cantilevered roller body and located substantially in a vertical axial plane of the printing roller unit (2), said support points having oppositely directed support faces (52, 55).

3. The assembly device of claim 1, wherein said holding device (27) includes an inner support member extending at least partly axially inside said roller core (4) for supporting said roller body (3).

4. The assembly device according to claim 1, wherein said holding device (27) is provided with a supporting arm, cantilevered in a substantially horizontal direction.

5. The assembly device according to claim 1, wherein said holding device (27) has at least one supporting head providing at least one gripper (29) for clamping a support portion (14) of the printing roller unit (2) located on at least one of sides defined by an outside and an inside of an end of the block sleeve (5).

6. The assembly device according to claim 5, wherein the support portion (14) is located at least partly between said sleeve end and an associated terminal end of said printing roller unit (2).

7. The assembly device according to claim 5, wherein said gripper (29) has a gripping receptacle (33) for receiving a circumferential portion of said printing roller unit (2) located proximate an end of the roller core (4).

8. The assembly device according to claim 1, wherein said gripper (29) has a gripping receptacle (33) for receiving a circumferential portion of said printing roller unit (2), said circumferential portion having a reduced diameter with respect to an external diameter of said roller core (4).

9. The assembly device according to claim 1, wherein said gripper (29) has a gripping receptacle (33) for receiving a circumferential portion of the printing roller unit (2), said circumferential portion forming a gap bottom (20) of an annular groove-like gap (11) located between the roller core (4) and a ring (9) on the roller unit (2).

10. The assembly device according to claim 9, wherein the ring (9) is an adjusting ring for adjusting the roller body (3).

11. The assembly device according to claim 5, wherein said gripper (29) is engageable exclusively between the roller core (4) and an interchangeable subassembly located adjacent to the roller core and comprising at least one of units providing a drive gear (12) and a ring (9).

12. The assembly device according to claim 1, wherein the holding device includes a gripper (29) for holding the roller body (3) in said mounting position.

13. The assembly device according to claim 5, wherein said gripper (29) is engageable with said roller body (3) in a motionless grip in at least one of directions defined by an axial and a radial direction.

14. The assembly device according to claim 1, wherein the holding device includes a gripper (29) having at least one locking member (41, 42) movably mounted in a body (30) of said gripper.

15. The assembly device according to claim 1, wherein said holding device (27) has at least one support member (40) for engaging in an axially open reception opening (18) of the roller body (3).

16. The assembly device according to claim 15, wherein said holding device includes a gripper body and said support member (40) projects axially in an annular segmental manner past an end face (54) of said gripper body (30), the reception opening (18) being annular groove in a corresponding end face of the roller core (4).

17. The assembly device according to claim 1, wherein said holding device (27) includes at least one axially operating displacement and locking member (41) for engaging a limited circumferential area of said roller body (3).

18. The assembly device according to claim 17, wherein said holding device (27) includes an annular or segmental support member (40) and said locking member (41) is located at an arc end of said annular segmental support member (40).

19. The assembly device according to claim 18, wherein said locking member (41) is constructed as a cam forming a guide member matingly corresponding to at least one of two flanks (15, 16) of a gap (11) of the roller body (3) in a release position and supporting against one of said two flanks (16) remote from said support member (40) in locked position.

20. The assembly device according to claim 1, wherein said holding device (27) includes at least one radially operating locking member (42) for engaging a limited circumferential area of said roller body (3).

21. The assembly device according to claim 20, wherein, said holding device (27) further includes an axially operating locking member (41) and a segmentally annular support member (40) said locking member (42) is separated by spacing from said axially operating locking member (41) and in the vicinity of an arc end of said segmentally annular support member (40).

22. The assembly device according to claim 20, wherein said locking member (42) is constructed as a radial bolt, forming a sensing and aligning member for engaging a guide surface (17) of the roller body (3) and moving to a locking position in a circumferential surface of a tapered end portion of the guide surface (17).

23. The assembly device according to claim 1, wherein said holding device (27) provides an insertion jaw (34) for substantially radially receiving the roller body (3).

24. The assembly device according to claim 23, wherein said insertion jaw (34) is constituted by a gripper (29) having a substantially segmentally annular gripper body (30) said gripper being open towards a downward direction and a freely accessible lateral side (25) of the roller body.

25. The assembly device according to claim 23, wherein said insertion jaw (34) extends over an arc angle between more than 90° and less than 180°.

26. The assembly device according to claim 23, wherein said insertion jaw (34) has at least one of members provided by a substantially tangentially elongated jaw leg (36) forming a tapered aligning member (37) and a securing member (41, 42) located at an end of at least one jaw leg (35, 36).

27. The assembly device according to claim 1, further including at least one inserting device (28) for inserting the printing roller (2) into the holding device.

28. The assembly device according to claim 27, wherein said inserting device (28) provides at least one of units defined by a lifting device (45) and a roller crane.

29. The assembly device according to claim 27, wherein said inserting device (28) is constructed for transferring said printing roller unit (2) completely from said operational bearing between an initial position and an inserting position.

30. The assembly device according to claim 27, further including control means for raising, lowering and stopping said inserting device (28) as a function of the position of locking members (421, 42) of said holding device (27) for locking said printing roller unit (2) with respect to said holding device (27).

31. The assembly device according to claim 27, wherein said at least one holding device (27) and at least one support member (47) of said inserting device (28) are resilient to give way with respect to one another when engaging.

32. The assembly device according to claim 27, further including a frame (23) and wherein a gripper (29) of said holding device (27) is mounted on said frame (23), thereby being movable substantially in an inserting direction (arrow 46) of said inserting device (28) and about an axis (32) substantially parallel to a roller axis (21) of said holding device (27).

33. The assembly device according to claim 1, wherein at least one gripper (29) of said holding device (27) and said printing roller unit (2) are substantially freely movable with respect to each other in an axial direction, when said printing roller unit (2) is out of said printing position.

34. The assembly device according to claim 33, further including an inserting device (28) having support members (47) for engaging end portions (8) of the printing roller unit (2), the end portions (8) being connected to the roller body (3) via roller bearings (6, 7), said support members (47) having axially oriented prismatic support and bearing faces (48) for said printing roller unit (2).

35. The assembly device according to claim 33, wherein said printing roller unit (2) is movable on linear roller tracks.

36. The assembly device according to claim 1, further including a frame (23 of a printing press (22) comprising two of said operational bearing, said printing roller unit (2) being freely extending on two longitudinal regions, said two bearings axially enclosing the roller core (4) and both ends over substantially an entire circumferential area in directions at right angles to roller axis (21) when in said mounting position.

37. The assembly device according to claim 27, wherein said holding device (27) and said inserting device (28) are provided respectively above and below said operational bearing.

* * * * *